US006695935B1

(12) United States Patent
Haszler et al.

(10) Patent No.: US 6,695,935 B1
(45) Date of Patent: Feb. 24, 2004

(54) EXFOLIATION RESISTANT ALUMINIUM MAGNESIUM ALLOY

(75) Inventors: Alfred Johann Peter Haszler, Vallendar (DE); Desikan Sampath, Koblenz (DE)

(73) Assignee: Corus Aluminium Walzprodukte GmbH, Koblenz (DE)

( * ) Notice: Subject to any disclaimer, the term of this patent is extended or adjusted under 35 U.S.C. 154(b) by 0 days.

(21) Appl. No.: 09/959,602

(22) PCT Filed: May 4, 2000

(86) PCT No.: PCT/EP00/04410

§ 371 (c)(1),
(2), (4) Date: Feb. 15, 2002

(87) PCT Pub. No.: WO00/66800

PCT Pub. Date: Nov. 9, 2000

(30) Foreign Application Priority Data

May 4, 1999 (EP) ..... 99201391

(51) Int. Cl.[7] ..... C22C 21/06

(52) U.S. Cl. ..... 148/440; 420/541; 420/544; 420/553

(58) Field of Search ..... 148/440; 420/544, 420/545, 553, 554, 543, 541

(56) References Cited

U.S. PATENT DOCUMENTS

| | | | | |
|---|---|---|---|---|
| 4,108,691 A | | 8/1978 | Stowell | |
| 4,238,233 A | | 12/1980 | Imaizumi et al. | |
| 5,032,359 A | * | 7/1991 | Pickens et al. | 148/417 |
| 5,342,429 A | * | 8/1994 | Yu et al. | 75/680 |
| 5,624,632 A | | 4/1997 | Baumann et al. | |
| 5,908,518 A | | 6/1999 | Hoffmann | |
| 6,342,113 B2 | * | 1/2002 | Haszler et al. | 148/439 |
| 6,416,884 B1 | * | 7/2002 | Haszler et al. | 428/654 |

FOREIGN PATENT DOCUMENTS

| | | | |
|---|---|---|---|
| EP | 0799900 | | 10/1997 |
| EP | 0823489 | | 2/1998 |
| FR | 2329758 | | 5/1977 |
| FR | 2717827 | | 9/1995 |
| JP | 56-163247 A | * | 12/1981 |
| WO | 9526420 | | 10/1995 |
| WO | 9942627 | | 8/1999 |
| WO | 0026020 | | 5/2000 |

OTHER PUBLICATIONS

"ASM Handbook vol. 2 Properties and Selection: Nonferrous Alloys and Special—Purpose Materials", ASM International, 1990, p 46.*

Raynaud, G.M. "New Aluminium Products for High Speed Light Crafts", International Forum on Aluminium Ships, pp. 1–18, XP000671311 (Sep. 20, 1995).

"ASM Specialty Handbook: Aluminum and Aluminum Alloys", ASM International, 1993, pp 40–41.*

* cited by examiner

*Primary Examiner*—George Wyszomierski
*Assistant Examiner*—Janelle Combs Morillo
(74) *Attorney, Agent, or Firm*—Stevens, Davis, Miller & Mosher, LLP

(57) ABSTRACT

Aluminum-magnesium alloy product for welded mechanical construction, having the following composition, in weight percent: Mg 3.5–6.0, Mn 0.4–1.2, Zn 0.4–1.5, Zr 0.25 max., Cr 0.3 max., Ti 0.2 max., Fe 0.5 max., Si 0.5 max., Cu 0.4 max.; one or more selected from the group: Bi 0.005–0.1, Pb 0.005–0.1, Sn 0.01–0.1, Ag 0.01–0.5, Sc 0.01–0.5, Li 0.01–0.5, V 0.01–0.3, Ce 0.01–0.3, Y 0.01–0.3, and Ni 0.01–0.3; others (each) 0.05 max., (total) 0.15 max.; and balance aluminum.

36 Claims, No Drawings

EXFOLIATION RESISTANT ALUMINIUM MAGNESIUM ALLOY

FIELD OF THE INVENTION

The present invention relates to an aluminium-magnesium alloy with a magnesium content in the range of 3.5 to 6 wt. % in the form of rolled products and extrusions, which are particularly suitable to be used in the form of sheets, plates or extrusions in the construction of welded or joined structures, such as storage containers and vessels for marine and land transportation. Extrusions of the alloy of the invention can be used as stiffeners in engineering constructions. Further the invention relates to a method of manufacturing the alloy of the invention.

DESCRIPTION OF THE PRIOR ART

For this invention reference is being made to aluminium wrought series alloys having a designation number in accordance with the Aluminium Association as published in February 1997 under "International Alloy Designations and Chemical Composition Limits for Wrought Aluminum and Wrought Aluminum Alloys".

In aluminium-magnesium alloys, theoretically, at room temperature up to about 1.8 wt. % Mg can be retained in solid solution. However, under practical conditions, up to about 3.0 wt. % Mg can be retained in solid solution. As a consequence, in aluminium-magnesium alloys containing more than 3.5 wt. % magnesium, the magnesium in solid solution is unstable and this unstable solid solution leads to grain boundary, anodic precipitations of $Al_8Mg_5$ intermetallics which in turn renders the material to be susceptible to corrosion attack. Mainly due to this reason, AA5454-series material in the soft temper (O-temper) are used in the construction of vessels which are expected to serve at temperatures above 65° C. In case of service temperatures below 65° C., AA5083-series material in the soft temper are commonly used. Material of the AA5083-series is significantly stronger than AA5454-series. Although stronger, the inferior corrosion resistance of the AA5083-series material limits its use to those applications where long term corrosion resistance at above ambient temperatures is not required. Because of the corrosion related problems, in general AA5xxx-series material having magnesium levels of only up to 3.0 wt. % are currently accepted for use in those applications which require service at temperatures above 80° C. This limitation on the magnesium level in turn limits the strength that can be achieved after welding and consequently on the allowed material thickness that can be used in the construction of structures such as tanker lorries.

Some disclosures of Al—Mg alloys found in the prior art literature will be mentioned below.

U.S. Pat. No. 4,238,233 discloses an aluminium alloy for cladding excellent in sacrificial anode property and erosion-corrosion resistance, which consists essentially of, in weight percentage:

| | |
|---|---|
| Zn | 0.3 to 3.0% |
| Mg | 0.2 to 4.0% |
| Mn | 0.3 to 2.0% |

balance aluminium and incidental impurities and further containing at least one element selected from the group consisting of:

| | |
|---|---|
| In | 0.005 to 0.2% |
| Sn | 0.01 to 0.3 |
| Bi | 0.01 to 0.3% |

provided that the total content of In, Sn and Bi being up to 0.3%.

This disclosure does not relate to the field of welded mechanical construction.

JP-A-05331587 discloses an aluminium alloy having a chemical composition of Mg 2.0 to 5.5% and 1 to 300 ppm, in total, of one or more elements selected from the group consisting of Pb, In, Sn, Ga and Ti, balance aluminium and impurities. Optionally further element like Cu, Zn, Mn, Cr, Zr, Ti may be added as alloying elements. The minor addition of Pb, In, Sn Ga, and Ti is to improve the adhesion of a plating film. Also, this disclosure does not relate to the field of welded mechanical construction.

FR-A-2,329,758 discloses an aluminium-magnesium alloy having Mg in the range of 2 to 8.5% and further having Cr in a range of 0.4 to 1.0% as a mandatory alloying element. This disclosure does not relate to the field of welded mechanical construction.

U.S. Pat. No. 5,624,632 discloses an substantially zinc-free and lithium-free aluminium alloy product for use as a damage tolerant product for aerospace applications.

SUMMARY OF THE INVENTION

An object of the present invention is to provide an aluminium-magnesium alloy in the form of a rolled product or an extruded product or a drawn product, combined with substantially improved long term corrosion resistance after welding as compared to those of the standard AA5454 alloy and having improved strength as compared to those of the standard AA5083 alloy.

A further object of present invention is to provide an aluminium-magnesium alloy in the form of a rolled product or an extruded product or a drawn product, combined with substantially improved exfoliation resistance after welding as compared to those of the standard AA5083 alloy.

Another object of present invention is to provide an aluminium-magnesium alloy in the form of a rolled product or an extruded product or a drawn product, combined with substantially improved exfoliation resistance after welding in a sensitised condition as compared to those of the standard AA5083 alloy.

According to the invention there is provided an aluminium-magnesium alloy product, preferably in the form of a rolled product or an extruded product or a drawn product, for welded mechanical construction, having the following composition, in weight percent:

| | | | |
|---|---|---|---|
| Mg | 3.5–6.0 | | |
| Mn | 0.4–1.2 | | |
| Zn | 0.4–1.5 | | |
| Zr | 0.25 max. | | |
| Cr | 0.3 max. | | |
| Ti | 0.2 max. | | |
| Fe | 0.5 max. | | |
| Si | 0.5 max. | | |
| Cu | 0.4 max. | | |
| one or more selected from the group: | | Bi | 0.005–0.1 |
| | | Pb | 0.005–0.1 |

-continued

| | | | |
|---|---|---|---|
| | | Sn | 0.01–0.1 |
| | | Ag | 0.01–0.5 |
| | | Sc | 0.01–0.5 |
| | | Li | 0.01–0.5 |
| | | V | 0.01–0.3 |
| | | Ce | 0.01–0.3 |
| | | Y | 0.01–0.3 |
| | | Ni | 0.01–0.3 |
| others | (each) 0.05 max.<br>(total) 0.15 max. | | |

balance aluminium.

By the invention we can provide aluminium-magnesium alloy products in the form of a rolled product or an extrusion, with substantially improved long term corrosion resistance in both soft temper (O-temper) and work- or strain-hardened temper (H-tempers) as compared to those of the standard AA5454 alloy and having improved strength as compared to those of the standard AA5083 alloy in the same temper. Further, alloy products of the present invention have also been found with improved long term exfoliation corrosion resistance at temperatures above 80° C., which is the maximum temperature of use for the AA5083 alloy. Further, the alloy products in accordance with the invention have been found to have an improved exfoliation corrosion resistance, in particular when brought in an sensitised condition.

The invention also consists in a welded structure having at least one welded plate or extrusion of the alloy set out above. Preferably the proof strength of the weld is at least 140 MPa.

The invention also consists in the use of the aluminium alloy of the invention as weld filler wire, and is preferably provided in the form of drawn wire.

It is believed that the surprisingly improved properties available with the invention are achieved by a careful selection of the combination of alloying elements. Particularly higher strength levels in both strain- or work-hardened (H-tempers) and soft tempers (O-tempers) are achieved by increasing the levels of Mg, Mn and adding Zr, and the long term corrosion resistance at higher Mg levels is achieved by precipitating anodic Mg and/or Zn containing intermetallics within the grains. In accordance with the invention it has been found that the grain interior precipitation can be further promoted by deliberate addition of one or more of the following elements selected from the group consisting of: Bi 0.005 to 0.1, Pb 0.005 to 0.1, Sn 0.01 to 0.1, Ag 0.01 to 0.5, Sc 0.01 to 0.5, Li 0.01 to 0.5, V 0.01 to 0.3, Ce 0.01 to 0.3, Y 0.01 to 0.3, and Ni 0.01 to 0.3.

The precipitation of Mg and/or Zn containing intermetallics within grains effectively reduces the volume fraction of grain boundary precipitated and highly anodic, binary AlMg intermetallics and thereby providing significant improvement in the corrosion resistance to the aluminium alloys at higher Mg levels employed. And furthermore, the deliberate additions of the indicated elements in the indicated ranges not only enhances grain body precipitation of anodic intermetallics but also, either discourage grain boundary precipitation, or disrupt continuity of anodic intermetallics that can otherwise be formed.

The reasons for the limitations of the alloying elements are described below. All composition percentages are by weight.

Mg: Mg is the primary strengthening element in the alloy. Mg levels below 3.5% do not provide the required weld strength and when the addition exceeds 6.0%, severe cracking occurs during hot rolling. The preferred Mg level is in the range of 4.0 to 5.6%, and a more preferred range is 4.6 to 5.6%.

Mn: Mn is an essential additive element. In combination with Mg, Mn provides the strength to both the rolled product and the welded joints of the alloy. Mn levels below 0.4% cannot provide sufficient strength to the welded joints of the alloy. Above 1.2% the hot rolling becomes very difficult. The preferred range for Mn is 0.4 to 0.9%, and more preferably in the range of 0.6 to 0.9%, which represents a compromise between strength and ease of fabrication.

Zn: Zn is an important additive for corrosion resistance of the alloy. Further zinc also contributes to some extent to the strength of the alloy in the work-hardened tempers. Below 0.4%, the Zn addition does not provide as much intergranular corrosion resistance equivalent to those AA5083 at Mg levels larger than 5.0%. At Zn levels above 1.5%, casting and subsequent hot rolling becomes difficult, especially on an industrial scale of manufacturing. A more preferred maximum for the Zn level is 0.9%. A very suitable range for the Zn is 0.5 to 0.9%, as a compromise in mechanical properties both before and after welding and corrosion resistance after welding.

Zr: Zr is important for achieving a fine grain refined structure in the fusion zone of welded joints using the alloy of the invention. Zr levels above 0.25% tend to result in very coarse needle-shaped primary particles which decrease ease of fabrication of the alloys and formability of the alloy rolled products or extrusions. The preferred minimum of Zr is 0.05%, and to provide sufficient grain refinement a preferred Zr range of 0.10 to 0.20% is employed.

Cr: Cr improves the corrosion resistance of the alloy. However, Cr limits the solubility of Mn and Zr. Therefore, to avoid formation of coarse primaries, the Cr level must not be more than 0.3%. A preferred range for Cr is up to 0.15%.

Ti: Ti is important as a grain refiner during solidification of both ingots and welded joints produced using the alloy of the invention. However, Ti in combination with Zr forms undesirable coarse primaries. To avoid this, Ti levels must be not more than 0.2% and the preferred range for Ti is not more than 0.1%.

Fe: Fe forms Al—Fe—Mn compounds during casting, thereby limiting the beneficial effects due to Mn. Fe levels above 0.5% causes formation of coarse primary particles which decrease the fatigue life of the welded joints of the alloy of the invention. The preferred range for Fe is 0.15 to 0.35%, and more preferably 0.20 to 0.30%.

Si: Si forms $Mg_2Si$ which is practically insoluble in aluminium-magnesium alloys containing more than 4.4% magnesium. Therefore, Si limits the beneficial effects of Mg. Further, Si also combines with Fe to form coarse AlFeSi phase particles which can affect the fatigue life of the welded joints of the alloy rolled product or extrusion. To avoid the loss in Mg as primary strengthening element, the Si level must be kept below 0.5%. The preferred range for Si is 0.07 to 0.25%, and more preferably 0.10 to 0.20%.

Cu: Cu should be not more than 0.4%. Cu, since Cu levels above 0.4% give rise to unacceptable deterioration in pitting corrosion resistance of the alloy of the invention. The preferred level for Cu is nor more than 0.1%.

Bi: In the case of deliberate low level addition, for example 0.005%, Bi preferentially segregates at grain boundaries. It is believed that this presence of Bi in the grain boundary networks discourage the precipitation of Mg containing intermetallics. At levels above 0.1%, weldability of the aluminium alloy of the present invention deteriorates to an unacceptable level. A preferred range for Bi addition is 0.01 to 0.1%, and more preferably 0.01 to 0.05%. It should be mentioned here that it is known in the art that small additions of bismuth, typically 20 to 200 ppm, can be added to aluminium-magnesium series wrought alloys to counteract the detrimental effect of sodium on hot cracking.

Pb and/or Sn: In case of low levels of addition, for example 0.01%, both Pb and/or Sn preferentially segregates at the grain boundaries. This presence of Pb and/or Sn in the grain boundary networks discourage the precipitation of Mg containing intermetallics. At levels of Pb and/or Sn above 0.1%, weldability of the alloys of the present invention deteriorates to an unacceptable level. A preferred minimum level for Pb addition is 0.005%, and for Sn a preferred minimum level is 0.01%. A more preferred range of Pb is 0.01 to 0.1%, and most preferably 0.03 to 0.1%. A more preferred range of Sn is 0.01 to 0.1%, and most preferably 0.03 to 0.1%. A preferred range of the combination of Sn and Pb is 0.01 to 0.1%, and more preferably 0.03 to 0.1%.

The elements Li, Sc, and Ag, either alone or in combination at levels above 0.5% forms Mg containing intermetallics which are present on the grain boundary thus disrupting formation of continuous binary Mg containing anodic intermetallics during long term service or during elevated temperature service of the aluminium alloy of this invention. The threshold level for these elements to produce interruptions to anodic grain boundary intermetallics network, depends on other elements in solid solution. When added, the preferred maximum for Li or/and Sc or/and Ag is 0.3%. The preferred minimum is 0.01%, and more preferably 0.1%. Above 0.5% Ag and Sc additions become economically unattractive. It has been found that the presence of Ag, Sc, and Li alone or in combination are most effective for the higher levels of Mg in the aluminium alloy, with a preference for Mg levels in the range of 4.6 to 5.6%.

The elements V, Ce, Y, and Ni when added individually or in combination at levels above 0.01% in the alloy of the invention form intermetallics primarily with aluminium. These intermetallics promote the precipitation of Mg containing anodic intermetallics in grain interiors. In addition, when present, they also provide strength at elevated temperatures to the alloy of the invention. However, at levels above 0.3% industrial casting becomes more difficult. A more preferred range for these alloying elements individually or in combination is in the range of 0.01 to 0.05%.

The balance is aluminium and inevitable impurities. Typically each impurity element is present at 0.05% maximum and the total of impurities is 0.15% maximum.

In a further aspect of the invention there is provided is a method for the manufacturing the aluminium alloy as set out above. The rolled products of the alloy of the invention can be manufactured by preheating, hot rolling, optionally cold rolling with or without interannealing, and final annealing/ageing of an Al—Mg alloy ingot of the selected composition. The reasons for the limitations of the processing route of the method in accordance with the invention are described below.

The preheating prior to hot rolling is usually carried out at a temperature in the range 300 to 530° C. The optional homogenisation treatment prior to preheating is usually carried out at a temperature in the range 350 to 580° C. in single or in multiple steps. In either case, homogenisation decreases the segregation of alloying elements in the material as cast. In multiple steps, Zr, Cr, and Mn can be intentionally precipitated out to control the microstructure of the hot mill exit material. If the treatment is carried out below 350° C., the resultant homogenisation effect is inadequate. If the temperature is above 580° C., eutectic melting might occur resulting in undesirable pore formation. The preferred time of the homogenisation treatment is between 1 and 24 hours.

Using a strictly controlled hot rolling process, it is possible to eliminate cold rolling and/or annealing steps in the process route for the plates.

A total 20 to 90% cold rolling reduction may be applied to hot rolled plate or sheet prior to final annealing. Cold rolling reductions such as 90% might require intermediate annealing treatment to avoid cracking during rolling. Final annealing or ageing can be carried out in cycles comprising of single or with multiple steps either case, during heat-up and/or hold and/or cooling down from the annealing temperature. The heat-up period is preferably in the range of 2 min to 15 hours. The annealing temperature is in the range of 80 to 550° C. depending on the temper. A temperature range of 200 to 480° C. is preferred to produce the soft tempers. The soak period at the annealing temperature is preferably in the range of 10 min to 10 hours. If applied, the conditions of intermediate annealing can be similar to those of the final annealing. Furthermore, the materials that exit the annealing furnace can be either water quenched or air cooled. The conditions of the intermediate annealing are similar to those of the final annealing. Stretching or levelling in the range of 0.5 to 10% may be applied to the final plate.

EXAMPLES

The following are non-limitative examples of the invention.

Example 1

On a laboratory scale of testing eight alloys have been cast, see Table 1 in which table (–) means <0.001 wt. %. Alloys 1 and 2 are comparative examples, of which alloy 1 is within the AA5454 range and alloy 2 within the AA5083 range. Alloys 3 to 8 are all examples of the alloy in accordance with this invention.

The cast ingots have been homogenised for 12 hours at 510° C., then hot rolled from 80 mm down to 13 mm. Then cold rolled from 13 mm to 6 mm thick plates. The cold rolled sheets have been annealed for 1 hour at 350° C., using a heat-up and cool down rate of 30° C./h, to produce soft temper materials. Using the AA5183 filler wire diameter of 1.2 mm, standard MIG welded panels (1000×1000×6 mm) were prepared. From the welded panels samples for tensile and corrosion test were prepared.

The tensile properties of the welded panels were determined using standard tensile tests. Resistance to pitting and exfoliation corrosion of the panels were assessed using the ASSET test in accordance with ASTM G66. Table 2 list the results obtained, and where N, PA and PB stands for no pitting, slight pitting and moderate pitting respectively. The assessment has been done for the base material, the heat affected zone (HAZ), and the weld seam. For the tensile properties "0.2% PS" stands for the 0.2% proof strength, "UTS" stands for ultimate tensile strength, and "Elong" stands for elongation at fracture.

From the results of Table 2 it can be seen that as compared to the reference alloys 1 and 2, the tensile properties of the alloy product in accordance with the invention are significantly higher. Further it can be seen from the ASSET test results the alloys in accordance with the invention are comparable to alloy, indicating that a similar corrosion resistance as AA5454 material is obtained, which may be contributed to the addition of either Bi, Ag or Li.

TABLE 1

Chemistries of the cast ingots.

| | Alloying element (in wt. %) | | | | | | | | | | | |
|---|---|---|---|---|---|---|---|---|---|---|---|---|
| Al | Mg | Mn | Zn | Zr | Cu | Cr | Fe | Si | Ti | Bi | Ag | Li |
| 1 | 2.70 | 0.75 | 0.02 | 0.01 | 0.05 | 0.10 | 0.30 | 0.15 | 0.10 | — | — | — |
| 2 | 4.50 | 0.53 | 0.09 | 0.01 | 0.03 | 0.05 | 0.15 | 0.09 | 0.10 | — | — | — |
| 3 | 4.85 | 0.65 | 0.59 | 0.10 | 0.03 | 0.04 | 0.15 | 0.09 | 0.10 | 0.07 | — | — |
| 4 | 5.30 | 0.84 | 0.55 | 0.13 | 0.04 | 0.05 | 0.19 | 0.11 | 0.01 | 0.05 | — | — |
| 5 | 4.62 | 0.65 | 0.52 | 0.12 | 0.03 | 0.03 | 0.15 | 0.09 | 0.10 | — | 0.05 | — |
| 6 | 5.15 | 0.84 | 0.55 | 0.13 | 0.01 | 0.05 | 0.19 | 0.11 | 0.01 | — | 0.07 | — |
| 7 | 4.79 | 0.65 | 0.61 | 0.12 | 0.03 | 0.05 | 0.15 | 0.09 | 0.10 | — | — | 0.30 |
| 8 | 5.26 | 0.84 | 0.55 | 0.13 | 0.02 | 0.04 | 0.19 | 0.11 | 0.01 | — | — | 0.15 |

TABLE 2

Experimental results.

| | | | | ASSET test results | | |
|---|---|---|---|---|---|---|
| Alloy | 0.2% PS [MPa] | UTS [MPa] | Elong. [%] | base material | HAZ | weld seam |
| 1 | 106 | 237 | 14 | N/PA | N/PA | N |
| 2 | 132 | 292 | 17 | PB | PA/PB | N |
| 3 | 150 | 325 | 20.5 | N/PA | N | N |
| 4 | 174 | 345 | 22 | N | N/PA | N |
| 5 | 152 | 331 | 20.7 | N | N | N |
| 6 | 170 | 349 | 31.3 | N | N/PA | N |
| 7 | 159 | 327 | 22.6 | N | N | N |
| 8 | 173 | 346 | 21.9 | N/PA | N/PA | N |

Example 2

On a laboratory scale of testing five aluminium alloys have been cast. The chemical compositions of these four alloys are listed in Table 3. Alloy 1 is a reference alloy within the range of standard AA5083 chemistry, and alloys 2 to 5 are examples of the aluminium alloy product in accordance with this invention.

The cast ingots have been processed down to a 1.6 mm gauge sheet product using the following processing route:

two-step pre-heat: 410° C. for 4 hours followed by 510° C. for 10 hours, with a heat-up rate of about 35° C./h;

hot rolling down to 4.3 mm thick sheets;

cold rolling to 2.6 mm thick sheets;

inter-annealing at 480° for 10 min;

final cold rolling down to 1.6 mm thick sheets;

annealing to produce their temper:

(a) O-temper: 480° C. for 15 min;

(b) H321-temper: 250° C. for 30 min;

stretching by 1% for O-temper material and stretching by 2% for H321-temper material;

TIG welding using AA5183 filler wire (analogue to Example 1);

sensitising of the welded panels depending on their temper:

(a) O-temper: 120° C. for 0, 10, 20, and 40 days (b) H321-temper: 100° C. for 4, 9, 16, and 25 days The tensile properties were tested for the both unwelded H321- and O-temper sheet materials. Euro-norm tensile specimens were machined along the rolling (L-) and LT-directions of the sheets. The tensile properties of the materials were determined using standard tensile tests. Table 4 lists the tensile test results for unwelded H321-temper material and Table 5 for the unwelded O-temper material.

The corrosion performance of welded materials have been assessed using ASSET test, performed according to ASTM G66 procedure. Tables 6 and 7 list the results obtained for H321-temper and O-temper material respectively, and the rates N, PA, PB, and PC respectively represent no pitting, slight pitting, moderate pitting and severe pitting degrees. EA and EB indicates slight and moderate exfoliation rendering. The assessment as been done for the base material and the heat affected zone (HAZ). In all cases the assessment for the weld seam was "N".

It can be seen from Tables 4 and 5, that the alloy products according to this invention show significantly higher tensile properties in comparison to the AA5083 alloy material in both the strain hardened H321- and the soft annealed O-tempers. When comparing the three different Bi-levels of alloys 2 to 4, no influence of an increasing Bi-level can be found on the tensile properties.

It can be seen from Tables 6 and 7, that the welded alloy products manufactured from the alloy product in accordance with the invention, both H-temper material and O-temper material, have an improved exfoliation corrosion resistance in comparison to the standard AA5083 alloy material. This effect is demonstrated for both the addition of Bi and V. This effect is more pronounced with increasing sensitisation.

TABLE 3

Chemistries of the cast ingots.

| | Alloying element (in wt. %) | | | | | | | | | | |
|---|---|---|---|---|---|---|---|---|---|---|---|
| Alloy | Mg | Mn | Zn | Zr | Fe | Si | Cu | Cr | Ti | Bi | V |
| 1 | 4.50 | 0.53 | 0.02 | 0.01 | 0.30 | 0.15 | 0.05 | 0.08 | 0.010 | — | — |
| 2 | 5.45 | 0.81 | 0.58 | 0.14 | 0.08 | 0.09 | 0.01 | 0.01 | 0.020 | 0.012 | — |

TABLE 3-continued

Chemistries of the cast ingots.

| Alloy | Alloying element (in wt. %) | | | | | | | | | | |
|---|---|---|---|---|---|---|---|---|---|---|---|
| | Mg | Mn | Zn | Zr | Fe | Si | Cu | Cr | Ti | Bi | V |
| 3 | 5.45 | 0.83 | 0.58 | 0.14 | 0.09 | 0.09 | 0.01 | 0.01 | 0.020 | 0.029 | — |
| 4 | 5.27 | 0.79 | 0.47 | 0.13 | 0.13 | 0.08 | 0.01 | 0.01 | 0.020 | 0.047 | — |
| 5 | 5.53 | 0.80 | 0.59 | 0.14 | 0.08 | 0.09 | 0.01 | 0.01 | 0.020 | — | 0.05 |

TABLE 4

Tensile properties of the base material in H321 temper.

| Alloy | LT-direction | | | L-direction | | |
|---|---|---|---|---|---|---|
| | 0.2% PS [MPa] | UTS [MPa] | Elong. [%] | 0.2% PS [MPa] | UTS [MPa] | Elong. [%] |
| 1 | 253 | 335 | 12.6 | 269 | 340 | 9.4 |
| 2 | 294 | 403 | 11.6 | 315 | 410 | 8.8 |
| 3 | 282 | 400 | 12.1 | 308 | 399 | 9.0 |
| 4 | 275 | 394 | 11.1 | 309 | 391 | 9.6 |
| 5 | 279 | 399 | 13.4 | 317 | 394 | 9.8 |

TABLE 5

Tensile properties of the base material in O-temper.

| Alloy | LT-direction | | | L-direction | | |
|---|---|---|---|---|---|---|
| | 0.2% PS [MPa] | UTS [MPa] | Elong. [%] | 0.2% PS [MPa] | UTS [MPa] | Elong. [%] |
| 1 | 132 | 294 | 19.0 | 145 | 296 | 17.8 |
| 2 | 163 | 339 | 21.0 | 180 | 335 | 18.1 |
| 3 | 163 | 342 | 20.7 | 181 | 340 | 17.8 |
| 4 | 166 | 345 | 21.5 | 171 | 344 | 17.3 |
| 5 | 164 | 336 | 19.0 | 166 | 332 | 19.7 |

TABLE 6

Corrosion performance of the alloys in H321-temper.

| Alloy | Sensi-tisation 100° C. | ASSET test results Base material vs. HAZ | |
|---|---|---|---|
| 1 | none | PB | PA |
| | 4 days | P | PA |
| | 9 days | PB | PA |
| | 16 days | PC/EA | PB |
| | 25 days | PC/EB | PC |
| 2 | none | N/PA | N |
| | 4 days | N/PA | N |
| | 9 days | N/PA | N |
| | 16 days | PA | N/PA |
| | 25 days | PA | N/PA |
| 3 | none | N/PA | N |
| | 4 days | N/PA | N |
| | 9 days | N/PA | N |
| | 16 days | PA | PA |
| | 25 days | PA/PB | PA |
| 4 | none | N/PA | N |
| | 4 days | N/PA | N |
| | 9 days | PA | N/PA |
| | 16 days | PA | PA |
| | 25 days | PA/PB | PA |
| 5 | none | N/PA | N |
| | 4 days | N/PA | N |
| | 9 days | PA | N/PA |

TABLE 6-continued

Corrosion performance of the alloys in H321-temper.

| Alloy | Sensi-tisation 100° C. | ASSET test results Base material vs. HAZ | |
|---|---|---|---|
| | 16 days | PA/PB | PA |
| | 25 days | PA/PB | PA/PB |

TABLE 7

Corrosion performance of the alloys in O-temper.

| Alloy | Sensi-tisation 120° C. | ASSET test results Base material vs. HAZ | |
|---|---|---|---|
| 1 | none | PA/PB | PA |
| | 10 days | PA/PB | PA |
| | 20 days | PA/PB | PA |
| | 40 days | PC/EA | PB/PC |
| 2 | none | N/PA | N |
| | 10 days | N/PA | N |
| | 20 days | PA | N |
| | 40 days | PA/PB | N/PA |
| 3 | none | N/PA | N |
| | 10 days | N/PA | N |
| | 20 days | PA | N |
| | 40 days | PB | PA |
| 4 | none | N/PA | N |
| | 10 days | N/PA | N |
| | 20 days | PA/PB | N |
| | 40 days | PB | N/PA |
| 5 | none | N/PA | N |
| | 10 days | N/PA | N |
| | 20 days | PA | N |
| | 40 days | PA/PB | N/PA |

While the invention has been described in conjunction with the exemplary embodiments described above, many equivalent modifications and variations will be apparent to those skilled in the art when given those disclosure. Accordingly, the exemplary embodiments of the invention set forth above are considered to be illustrative and not limiting. Various changes to the described embodiments may be made without departing from the spirit and scope of the invention.

What is claimed is:

1. Aluminium-magnesium alloy product for welded mechanical construction, consisting essentially of, in weight percent:

| | |
|---|---|
| Mg | 4.0–5.6 |
| Mn | 0.4–1.2 |

-continued

| | |
|---|---|
| Zn | 0.4–1.5 |
| Zr | 0.25 max. |
| Cr | 0.3 max. |
| Ti | 0.2 max. |
| Fe | 0.5 max. |
| Si | 0.5 max. |
| Cu | 0.4 max,; |
| Bi | 0.01–0.1 and |
| impurities | 0.05 max. each<br>0.15 max. total; and |

balance aluminium.

2. Aluminium-magnesium alloy product according to claim 1, wherein the Bi content is in the range of 0.01 to 0.05 wt. %.

3. Aluminium-magnesium alloy product according to claim 1, wherein the Mg content is in the range of 4.6 to 5.6 wt. %.

4. Aluminium-magnesium alloy product according to claim 1, wherein the Zn content is in the range of 0.4 to 0.9 wt. %.

5. Aluminium-magnesium alloy product according to claim 1, wherein the Zr content is in the range of 0.05 to 0.25 wt. %.

6. Aluminium-magnesium alloy product according to claim 1, wherein the product is provided in the form of a rolled product.

7. Aluminium-magnesium alloy product according to claim 1, having a temper selected from O temper and a work-hardened temper.

8. Welded structure according to claim 7, having an exfoliation resistance of PA or better in an ASSET test in accordance with ASTM G66 and when sensitized in a work hardened temper for 16 days at 100° C.

9. Welded structure comprising at least one welded plate or extrusion made of aluminium-magnesium alloy product according to claim 1.

10. Welded structure according to claim 9, wherein the proof strength of the weld of said welded plate or extrusion is at least 140 MPa.

11. Welded structure according to claim 9, having an improved resistance to exfoliation when sensitized for at least 10 days at 120° C.

12. Welded structure according to claim 9, having an exfoliation resistance of PA or better in an ASSET test in accordance with ASTM G66 and when sensitized in O temper for 20 days at 120° C.

13. Welded structure according to claim 9, wherein the welded structure is a marine vessel.

14. Welded structure according to claim 9, wherein the welded structure is a container for land transportation.

15. A method of use of an aluminium-magnesium alloy product according to claim 1, comprising exposing the product to an operating temperature greater than 80° C.

16. Aluminium-magnesium alloy product according to claim 1, wherein the Mn content is in the range of 0.4 to 0.9 wt. %.

17. Aluminium-magnesium alloy product according to claim 1, wherein the Mn content is in the range of 0.6 to 0.9 wt. %.

18. Aluminium-magnesium alloy product according to claim 1, wherein the Zn content is in the range of 0.5 to 0.9 wt. %.

19. Aluminium-magnesium alloy product according to claim 1, wherein the Zr content is in the range of 0.05 to 0.20 wt. %.

20. Aluminium-magnesium alloy product according to claim 1, wherein the Zr content is in the range of 0.10 to 0.20 wt. %.

21. Aluminium-magnesium alloy product according to claim 1, wherein the Fe content is in the range of 0.15 to 0.35 wt. %.

22. Aluminium-magnesium alloy product according to claim 1, wherein the Fe content is in the range of 0.20 to 0.30 wt. %.

23. Aluminium-magnesium alloy product according to claim 1, wherein the Si content is in the range of 0.07 to 0.25 wt. %.

24. Aluminium-magnesium alloy product according to claim 1, wherein the Si content is in the range of 0.10 to 0.20 wt. %.

25. Aluminium-magnesium alloy product according to claim 1, wherein the Cu content is 0.1 wt. % max.

26. Aluminium-magnesium alloy product according to claim 1, wherein the Bi content is in the range of 0.01 to 0.05 wt. %.

27. Aluminium-magnesium alloy product according to claim 1, wherein the product is provided in the form of an extrusion.

28. Aluminium-magnesium alloy product according to claim 1, wherein the product is provided in the form of a drawn product.

29. Aluminium-magnesium alloy product for welded mechanical construction, consisting of, in weight percent:

| | |
|---|---|
| Mg | 4.0–5.6 |
| Mn | 0.4–1.2 |
| Zn | 0.4–1.5 |
| Zr | 0.25 max. |
| Cr | 0.3 max. |
| Ti | 0.2 max. |
| Fe | 0.5 max. |
| Si | 0.5 max. |
| Cu | 0.4 max.; |
| Bi | 0.01–0.1; and |
| impurities | 0.05 max. each,<br>0.15 max. total; |

balance aluminium.

30. Aluminium-magnesium alloy product for welded mechanical construction, consisting essentially of, in weight percent:

| | |
|---|---|
| Mg | 4.0–5.6 |
| Mn | 0.4–1.2 |
| Zn | 0.4–1.5 |
| Zr | 0.25 max. |
| Cr | 0.3 max. |
| Ti | 0.2 max. |
| Fe | 0.5 max. |
| Si | 0.5 max. |
| Cu | 0.4 max.; |
| Bi | 0.029–0.1 and |
| impurities | 0.05 max. each<br>0.15 max. total; and |

balance aluminium.

31. Aluminium-magnesium alloy product according to claim 30, wherein the Bi content is in the range of 0.05–0.1 wt. %.

32. Aluminium-magnesium alloy product according to claim 30, wherein the Fe content is in the range of 0.15 to 0.35 wt. %.

33. Aluminium-magnesium alloy product according to claim 30, wherein the Fe content is in the range of 0.20 to 0.30 wt. %.

34. Aluminium-magnesium alloy product according to claim 30, wherein the Si content is in the range of 0.07 to 0.25 wt. %.

35. Aluminium-magnesium alloy product according to claim 30, wherein the Si content is in the range of 0.10 to 0.20 wt. %.

36. Aluminium-magnesium alloy product according to claim 30, wherein the Cu content is 0.1 wt. % max.

* * * * *